United States Patent [19]

Koepp

[11] 4,206,772

[45] Jun. 10, 1980

[54] AUTOMATIC SELF-LOCKING COMB HAIR ROLLER

[76] Inventor: Jacqueline F. Koepp, Box O, Madisonville, La. 70447

[21] Appl. No.: 706,435

[22] Filed: Jul. 19, 1976

[51] Int. Cl.[2] ..... A45D 2/18

[52] U.S. Cl. ..... 132/43 R

[58] Field of Search ..... 132/43 R, 39, 40, 41, 132/42; 128/269

[56] References Cited

U.S. PATENT DOCUMENTS

| | | | |
|---|---|---|---|
| 1,516,454 | 11/1924 | Norton | 128/269 |
| 2,600,727 | 6/1952 | Berman et al. | 132/40 |
| 2,720,207 | 10/1955 | Burtnett | 132/43 R |
| 3,232,300 | 2/1966 | Fisher | 132/39 |
| 3,326,222 | 6/1967 | Rosenheim | 132/40 |
| 3,444,864 | 5/1969 | Glushakow | 132/38 R |
| 3,970,095 | 7/1976 | Prince | 132/39 |

*Primary Examiner*—G. E. McNeil
*Attorney, Agent, or Firm*—C. Emmett Pugh & Associates

[57] ABSTRACT

An apparatus and method for curling hair which includes a hair roller featuring an elongated resilient open mesh strip of inherently spring coil design with gripping combs attached to its extreme end portions. The hair roller is provided with resilient means, e.g. three spring wires, for urging the roller into its coiled positon (FIG. 3). A setting lotion packet (FIGS. 3 & 4) including a container surrounded by a foam diffusing strip can be coiled with a strand of hair in the hair roller and the container ruptured to dispense its contents to the curled hair strand. Numerical scales are included along the edges of the roller as a guide in its positioning on the hair strand. Methods of application of the hair roller are sequentially illustrated in FIGS. 6 and 7.

11 Claims, 12 Drawing Figures

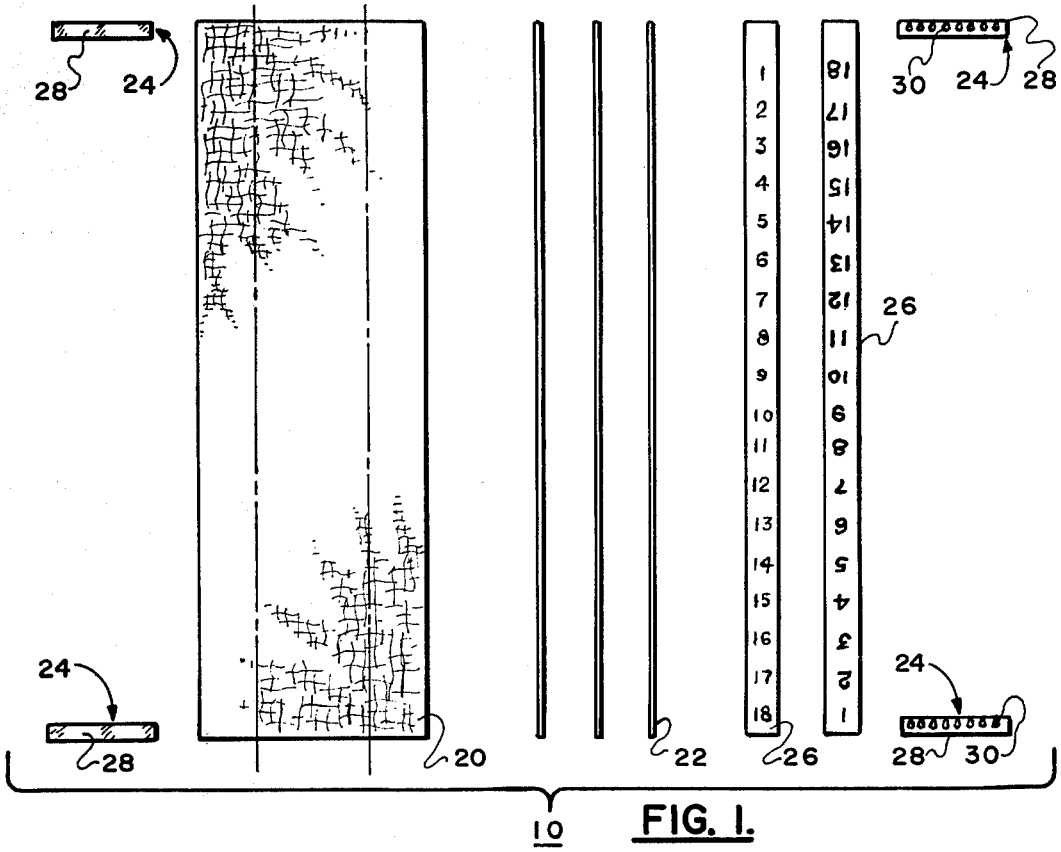
FIG. 1.
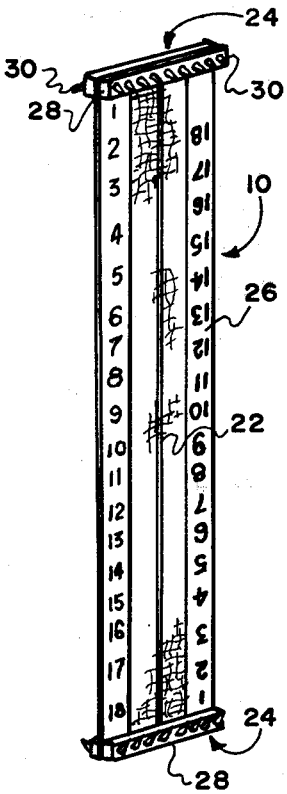
FIG. 2.
FIG. 3.
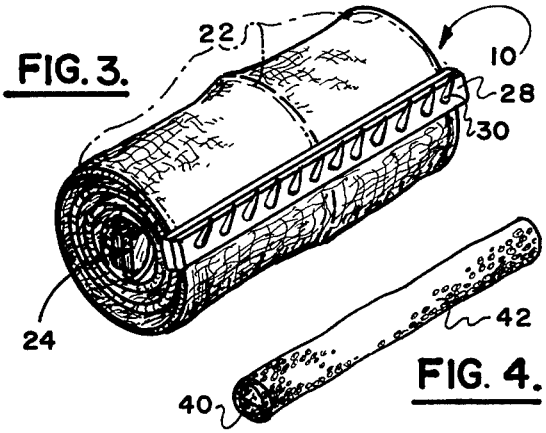
FIG. 4.
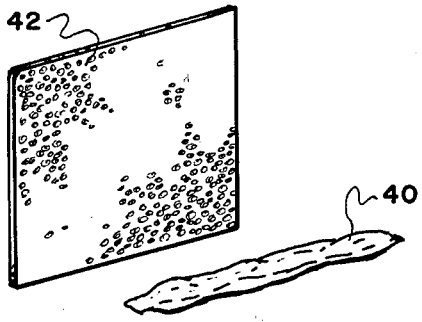
FIG. 5.

AUTOMATIC SELF-LOCKING COMB HAIR ROLLER

BACKGROUND OF THE INVENTION

1. Field of the Invention

The present invention relates to a hair roller and its method of use. The hair roller of the present invention automatically rolls a strand of hair and packet of hair-treating liquid such as for example permanent wave, tinting or setting lotion, into a curled position and retains the hair strand in a curled position while the user ruptures the packet dispensing the setting lotion into the curled strand of hair.

2. Prior Art

In the styling of hair it is known to use hair rollers having a resiliency allowing the stylist to curl a strand of hair and thereafter to secure the curled strand and roller for a desired setting time.

Typical examples of automatic hair rollers are shown in the following U.S. Patents:

| Patent No. | Inventor | Issue Date |
|---|---|---|
| 2,166,386 | M. Auster | July 18, 1939 |
| 2,663,302 | R. N. Palitti | Dec. 22, 1953 |
| 2,720,207 | H. J. Burnett | Oct. 11, 1955 |
| 3,255,765 | M. Sturdivant | June 14, 1966 |
| 3,590,829 | V. Parisi | July 6, 1971 |

However, the curlers of the prior art are generally complex, requiring several operations by the user thereby lengthening the time required to style one's hair, or requiring the aid of another. This complexity and inconvenience is particularly associated with the means used for securing the roller and encurled strand of hair in its styling position. In the past, hair roller securing means usually comprised various interlocking parts, snaps, ties or the like, requiring the use of more than one hand to operate. Moreover, some prior art rollers require an additional step of orientation of the roller in a particular fashion with the strand of hair in order to operate properly. Most prior art hair rollers require that any desired setting lotion or the like be applied to the user's hair prior to the application of the roller.

Thus, the styling operation has been time consuming, messy and difficult using rollers of the prior art.

An additional problem encountered with rollers of the prior art is the need for several varying size rollers to achieve assorted curl features or to curl different lengths of hair.

3. General Discussion of the Present Invention

The present invention eliminates all of the prior art problems and shortcomings in a simple, clean, and inexpensive manner. The present invention permits a single user to curl hair strands of any length, on either wet or dry hair. A strand of hair can be curled in either direction, by placing the present invention on either the top side or bottom side of the hair strand. The curling operation can commence from either end of the roller of the present invention.

It is a further object of the present invention to provide a method for setting hair which allows the user to apply rollers to the hair when dry and thereafter release lotion into the curled hair strands.

The present invention in its preferred embodiment is complete within itself and nothing else is needed but the hair to be set. The locking comb endings in the preferred embodiment can be used to comb out and untangle the strand of hair to be rolled. The end combs also act as or replace the standard pick to secure the roll, eliminating the extra aggravation of detached picks.

The rollers of the present invention are so lightweight and soft that the wearer can sleep in them without discomfort.

The construction and materials used are such that they can be used over and over again without damage, and should last for several years. All of the parts are preferrably of nylon, plastic or are plastic coated so that they can be used with permanent waving and hair tinting chemicals safely.

Different sizes and lengths will give the professional hair stylist or individual a wide selection of choices for most hair styles.

It should be understood that the main body of the curler preferrably is made of a completely open mesh or netting that allows the hair to circulate through the hair from every angle for even and faster drying.

The coil spring insets for the automatic roll of the present invention can be made of either spring steel coated with plastic or of plastic. This automation speeds up the setting process by three or more steps, not counting the steps saved in not having to use a separate comb and separate picks as in the prior art.

The measuring tapes with markings every inch helps to determine the length of hair to be rolled and the starting position on the curler for each individual.

The two plastic combs, one in each end of the curler, each with the two sides of spiked combs, form a three way locking system which is very important. One lock is the inside comb which is used like a core to help wind the curl, and the teeth from both sides of the comb pierce the netting, therefore, anchoring the inside end securely. These inside teeth are also used with the permanent wave capsule to puncture the capsule and release the waving solution.

The second locking position is in the spiked comb on the outside or other end, which when the roll or curl is completed one side of the comb is pushed into the netting to lock the curl at the base or root end of the hair.

The third lock is at the base of the second roll of hair. When completed the remaining spiked side of the comb is pushed through or into the first or previous curl, locking one to the other, as is each consecutive curl. The interlocking of one curl to the other forms a tight, net-like cover for the whole head, causing the curls to stay in place firmly until the rollers are removed.

BRIEF DESCRIPTION OF THE DRAWINGS

For a further understanding of the nature and objects of the present invention, reference should be had to the following description, taken in conjunction with the accompanying drawings, in which like parts are given like reference numerals and wherein:

FIG. 1 is an exploded view of the roller element of the preferred embodiment of the apparatus of the present invention;

FIGS. 2 and 3 are perspective views of the roller element of the present invention;

FIGS. 4 and 5 are perspective views of the lotion packet and wrapper diffuser elements of the present invention.

DETAILED DESCRIPTION OF THE PREFERRED EMBODIMENT

Structure

Figure 6A:
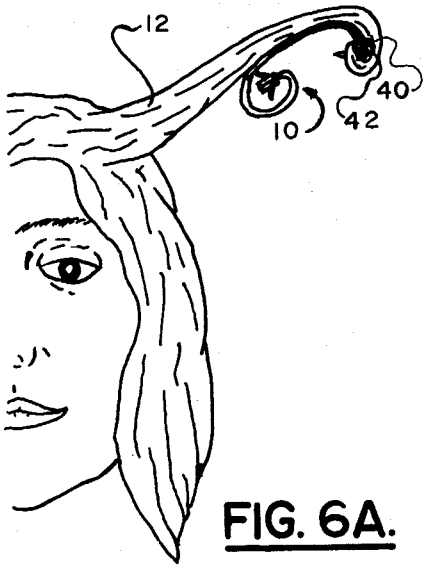
FIGS. 6A through 6D and 7A through 7C are elevation views illustrating the sequential steps of two different methods of applying the preferred embodiment of the present invention to a strand of hair.
Figure 6B:
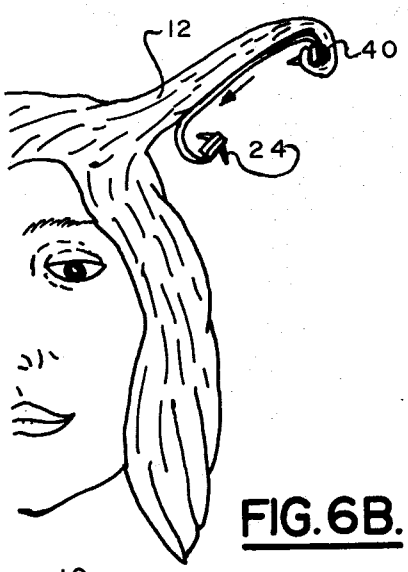

As shown in FIGS. 1–3, the preferred embodiment of the automatic hair roller of the present invention, designated generally by the numeral 10, comprises an elongated strip 20, provided with a plurality of coil spring wires 22, and preferrably two pairs of combs 24 fastened at its opposite ends respectively. Linear scales 26 can be placed along the strip 20 for measuring hair strand length.

Elongated strip 20 can be made of open mesh nylon net or the like, having a preferred exemplary width of five and one-half inches and a preferred exemplary length of fourteen to twenty-four inches.

Coil springs 22 are preferrably pre-rolled, constant force spring steel or like resilient material having a memory, whereby springs 22 will return to a coiled position after being extended and released. Coil spring wires 22 are preferrably coated with plastic or the like to resist chemical attack by setting lotions. An example of a suitable coil spring wire 22 is that type used in blow-out party favors as manufactured by G. C. Murphy Co., McKeesport, Pa. 15132. Preferrably two to five coil spring wires 22 are attached to strip 20, an exemplary three being illustrated, using conventional means such as sewing or laminating, using glue or the like.

In construction in the preferred embodiment, strip 20 is folded approximately in half doubling its thickness and enclosing coil springs 22 prior to their attachment by sewing. After attachment of coil spring wires 22, strip 20 has a reduced width of two and one-half inches, with coil spring wires 22 sandwiched between the double thickness of strip 20.

Combs 25, affixed to the opposite ends respectively of strip 20, are preferrably moldable, self-hardening plastic, for example "Castolite". In the preferred embodiment, two pairs of combs 24 of substantially identical structure and construction are provided. Each comb 24 is comprised of a bar 28 having a single, linear, lateral row of teeth 30 set at a slight angle to bar 28. Bar 28 can be, for example, approximately one-quarter inch to one-half inch wide and two and one-half inches long with a thickness of one-eighth inch to three-sixteenth inches. Teeth 30, preferrably an exemplary one-quarter to five-eighths inches long, are arranged in a straight row parallel with the longitudinal axis of bar 28 and extend out at an angle for example, of approximately thirty to sixty degrees. Combs 24 can be manufactured of plastic on the like using conventional means such as injection molding.

Combs 24 are affixed in pairs to the opposite ends respectively of strip 20. Combs 24 are oriented perpendicular to the longitudinal axis of strip 20, with each row of teeth 30 facing out and toward the middle portion of strip 20 (see FIG. 2). Attachment of combs 24 to strip 20 is by conventional means such as sewing, laminating with adhesive material, or the like.

For convenience in measuring hair strand length, the roller 10 of the preferred embodiment is provided with a pair of scales 26 affixed to strip 20 substantially parallell with its longitudinal axis. The scales 26 provide a way to the user of knowing how far to unroll the hair curler roll 10 prior to setting the hair. Thus, for example, if the strand of hair to be rolled is eight inches long, the user will unroll the curler 10 to eight inches from either end, add one to two inches for overwrap, lock the curler in place, and proceed with the set.

Scales 26, preferrably graduated in inches, are oriented in opposite sequential directions, thereby enabling the user to measure hair strand length from either end of roller 10 (see FIG. 2). Scales 26 can be, for example, any conventional self-adhesive plastic tape graduated, for example, in inches or metric liner units using indelible ink or other fixed indicator.

As a preferred adjunct to the hair roller of this invention as illustrated in FIGS. 1–3, there is included a setting lotion packet 40 and diffuser liner 42, illustrated in FIGS. 4 and 5. Liner 42 is made, for example, of thin, soft, absorbent foam plastic or rubber or the like with a preferred exemplary length and width of two and one-half inches, corresponding to the width of strip 20, and a preferred exemplary thickness of one-sixteenth inches. Setting lotion packet 40 can be, for example, any substantially watertight enlongated container having relatively thin wall thickness, or being otherwise easily rupturable by the user. Desired setting lotion or the like, such as, for example, a permanent wave solution, is enclosed therein. Packet 40, likewise has a preferred exemplary length of two and one-half inches. Packet 40 wrapped in liner 42 (see FIG. 4) is located at the center of roller 10 while in its curled position (FIG. 3). Rupture of packet 40 releases its contents into liner 42 and subsequently the contents smoothly and evenly diffuse through liner 42 into the curled strand of hair secured by roller 10. The liner 42 and capsule packet 40 can be pre-packaged together with the foam liner 42 stitched into a cylindrical configuration (as shown in FIG. 4) about the capsule 40.

Method of Use

The preferred method of application of the present invention is illustrated in FIGS. 6A–6D and 7A–7C. As can be seen, the roller 10 can be applied to either side of the strand of hair to be curled. If setting lotion is desired, the user can enclose packet 40 covered with liner 42 in the coiled roller.

FIGS. 6A–6D illustrate the method of operation of roller 10 when placed on the lower side of a strand of hair 12. In operation the tip of a strand of hair 12 is wrapped around one of the pairs of combs 24 located at either end of the roller 10, and if desired, setting lotion packet 40 is included with the roller (see FIG. 6A). Roller 10 is extended placing its opposite end near the base of hair stand 12 (see FIG. 6B).

Figure 6C:
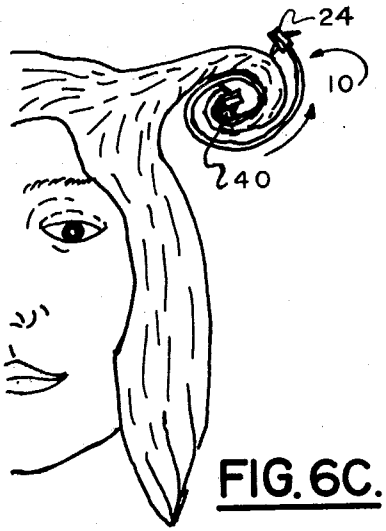
Figure 6D:
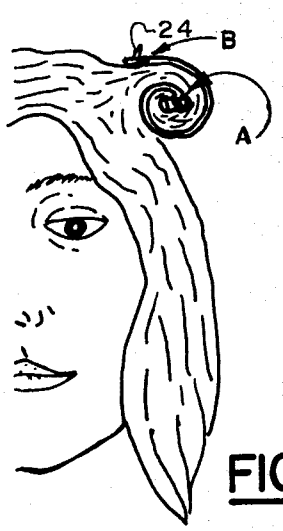

The outermost end of roller 10 is slowly relaxed, allowing roller 10 to roll into a coil while at the same time rolling hair strand 12 in the coil (FIG. 6C). The outermost tip of the coiled roller 10 is attached to the base of hair stand 12 using comb 24 (see FIG. 6D).

Figure 7A:
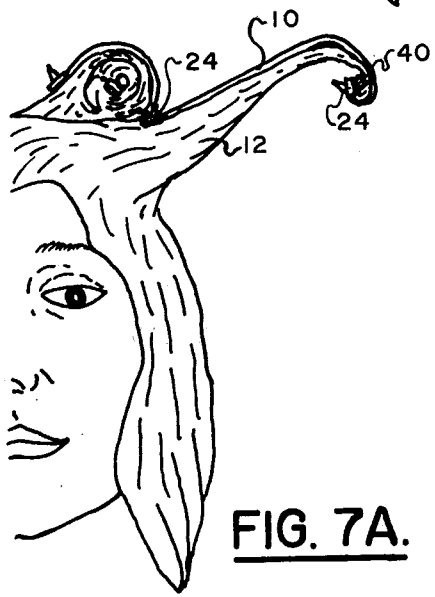
Figure 7B:
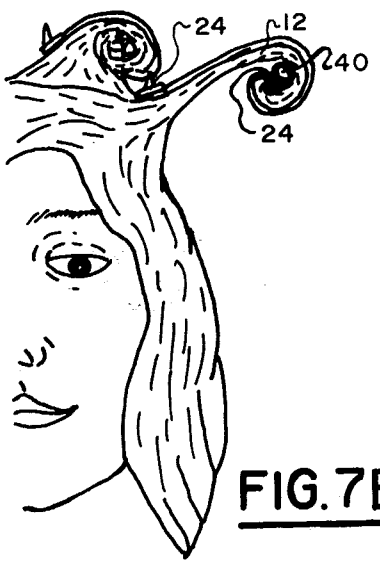
Figure 7C:
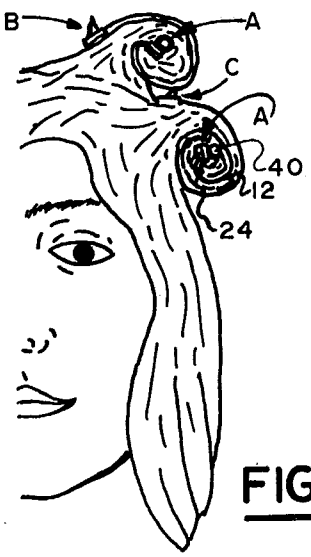

FIGS. 7A–7C illustrate the method of operation of roller 10 when placed on the upper side of a strand of hair 12. Comb 24 is anchored in the base of hair strand 12. Roller 10 is extended and placed in proximity to hair strand 12 (see FIG. 7B). The tip of strand 12 is wrapped around comb 24 and, if desired, setting lotion packet 40 is also included (see FIG. 7B). The outer tip of roller 40 is slowly released allowing roller 10 to roll into a coil while at the same time rolling a strand of hair 12 and, if desired, packet 40 into the coil (FIG. 7C). Alternatively but not preferably, the packet or capsule 40 can be inserted in the center of the roller 10 after it is in its rolled disposition.

If packet 40 and foam liner 42 are used, packet 40 is lanced or ruptured by the user, dispensing setting lotion or the like into liner 42 and hair strand 12. Liner 42 acts as a diffuser to distribute the setting lotion evenly to curled hair strand 12.

Basically the packet or capsule 40 which can be made of soft plastic contains the permanent wave, setting or tinting solution which, when punctured by the sharp teeth 30 of the hair curler 10, releases the solution to be worked through the hair in the roll. The capsule can be inserted into the center opening of the hair roller 10 after all of the hair is set or rolled.

Once there the user pinches the roll of hair and punctures the capsule 40. The liner or shell 42 blots and absorbs the wave solution to be pinched and worked through the hair evenly. This technique of the present invention saves time and makes a permanent much less messy and troublesome.

Thus, in greater detail, the preferred methods of the present invention includes the use of the roller 10 and the numerical markings 26 to unroll and find the approximate length of the hair and adding an extra one or two inches. Starting with the closest end of roller 10 and unwinding it to the desired number, the end of the hair is placed along the marking already chosen for the hair length and manually started end over roll until the ends are secure. The rolled hair is held in place with one hand, and with the other hand the remainder of the roller 10 is unwound down to the base of the hair growth and pushed up tight against the scalp to stretch and smooth the length of hair to be rolled. Now the other end with the hair end secured is allowed to roll slowly and automatically down to the hair root. The user twists once in direction of roll to tighten the roll, and the remaining few inches of roller 10 are then brought up and over the top of curl or roll of hair and comb end is pinched into and through the netting of the body of the roller 10 to hold the roller 10 in place.

To secure even tighter, the user can further anchor the roller 10 with an ordinary pick. However, once the simple technique of the present invention has been mastered and one is able to judge the exact length of roller to use for hair length, picks should no longer be necessary.

The roller 10 of the present invention shortens hair setting time from two or more steps to each curl, and the roller 10 can be re-used over and over.

Roller can be selected according to desired firmness of curl and hair style preference, sizes starting from for example one-half inch radius or small, three-forths inch, medium, one inch, large, two inch, extra large, and three inches radius, jumbo, measurements.

The rollers 10 can be worked from either end and locked in place by the comb 24, and the hair can be rolled either inside of the roll as well as outside and over the top of roll again according to the setter's performance. The rollers 10 are soft and flexible and cannot, in any way, damage the hair.

In addition to the advantages of the use of an individual roller 10, interrelated use of a number of rollers can also be very advantageous. For example, noting particularly FIG. 7C, the two plastic combs 24, one in each end of the curler 10, each with the two sides of spiked combs 30, can be used to form a three-way locking system which is very important. One lock "A" (note FIG. 7C) is the inside comb which is used like a core to help wind the curl, and the teeth from both sides of the comb pierce the netting 20 of the curler 10, thereby anchoring the inside end securely. These inside teeth are also used with the capsule 40 to puncture the capsule and release the hair treating solution.

The second locking position "B" is in the spiked comb on the outside or other end, which, when the roll or curl is completed, one side of the comb is pushed into the netting to lock the curl at the base or root end of the hair.

The third lock "C" is at the base of the second roll of hair. When completed the remaining spiked side of the comb is pushed through or into the first or previous curl locking one to the other, as is each consecutive curl. The interlocking of one curl to the other forms a tight net like cover for the whole head, making it stay in place firmly until removed.

Although a particular detailed embodiment of the hair roller has been described and illustrated, it should be understood that the invention is not restricted to the details of the preferred embodiment, and many changes in design, configuration and dimensions are possible within the scope of the invention.

What is claimed as invention is:

1. An automatic hair treatment roller, comprising:

a. an elongated strip of material, said strip being of open mesh design allowing fluids to flow therethrough, there being further included an auxiliary, easily rupturable packet of hair treating liquid insertable in the area of said strip which is at the center of the hair roller when it is rolled up;

b. first means for gripping a strand of hair and for piercing the rupturable packet to allow the hair treating liquid to flow into the hair, said first gripping means being located at one end portion of said elongated strip, said first gripping means prividing a row of projecting hair gripping comb tines;

c. second means for gripping a strand of hair, said second gripping means being located at the opposite end portion of said elongated strip from said first gripping means, said second gripping means providing a row of hair gripping comb tines; and d. resilient means for urging said elongated strip into a coiled position, so that when a strand of hair is applied to said elongated strip, in an extended position, said gripping means engages and holds one end of said strand of hair, said second gripping means holds the opposite end of said strand of hair, and said strip and said strand of hair will roll into a curled position when said strip is released.

2. The apparatus of claim 1 wherein said first gripping means and said second gripping means are pairs of toothed combs, each pair of said toothed combs, of said strip of material with the two toothed combs of each pair attached on opposite surfaces of said strip of material, providing a hair gripping surface on each side of each end portion of said strip of material.

3. The apparatus of claim 2 wherein said toothed combs are each comprised of a set of spikes projecting out away from the surface of said strip and back towards the center of said strip, the sets being included on both sides of said strip as well as at said end portions.

4. The apparatus of claim 1 wherein said urging means is a plurality of resilient coil spring wires longitudinally fastened to and along said strip and said strip is made of open mesh material.

5. The apparatus of claim 1 wherein there is further included scale means located on and along the length of said strip for measuring hair strand length when said strip of material is held in an elongated stretched-out position.

6. The apparatus of claim 5 wherein said measuring means is a linear scale affixed longitudinally to said elongated strip.

7. The apparatus of claim 1 wherein said packet is at least generally cylindrical in shape.

8. The apparatus of claim 1 wherein said packet includes on its exterior diffusing means for diffusing the liquid released from the ruptured packet to flow smoothly into the hair.

9. The apparatus of claim 8 wherein said diffusing means is a layer of foam material.

10. A method of curling and treating a strand of hair, comprising the steps of:

a. providing a hair roller comprising an elongated strip of material of open mesh design allowing fluids to flow therethrough and having at least first means for gripping a strand of hair located at one end portion of said elongated strip, said gripping means providing a row of hair gripping comb tines formed by sharp, projecting spikes, said roller having resilient means for urging the roller strip into a curled position, said spikes, said strip of open mesh design and said resilient means being located relatively to one another allowing the spikes to pierce internally through the open mesh when the roller is curled up;

b. extending the hair roller strip having resilient means for urging the roller strip into a curled position;

c. aligning a strand of hair with the hair roller;

d. releasing the roller strip so that the strip will roll the strand of hair into a curled formation; which method further includes the steps of e. inserting an easily rupturable packet of hair treating liquid at the area of said strip which is at the center of the curled hair strand when the roller is rolled up; and f. rupturing the packet by forcing said spikes through said packet to rupture it so that the hair treating liquid will be dispensed into the curled strand of hair.

11. The method of claim 10 in which step "e" is performed before step "d".

* * * * *

UNITED STATES PATENT AND TRADEMARK OFFICE

CERTIFICATE OF CORRECTION

PATENT NO. : 4,206,772

DATED : June 10, 1980

INVENTOR(S) : Jacqueline F. Koepp

It is certified that error appears in the above-identified patent and that said Letters Patent are hereby corrected as shown below:

Column 2, line 19, "hair" is changed to --air--.

Signed and Sealed this

*Nineteenth* Day of *August 1980*

[SEAL]

*Attest:*

SIDNEY A. DIAMOND

*Attesting Officer*

*Commissioner of Patents and Trademarks*